US005506468A

United States Patent [19]

Koh

[11] Patent Number: 5,506,468

[45] Date of Patent: Apr. 9, 1996

[54] ELECTRON GUN FOR COLOR CATHODE-RAY TUBE

[75] Inventor: Nam J. Koh, Kyungsangbuk-Do, Rep. of Korea

[73] Assignee: Goldstar Co., Ltd., Seoul, Rep. of Korea

[21] Appl. No.: 80,846

[22] Filed: Jun. 24, 1993

[51] Int. Cl.[6] ..... H01J 29/62

[52] U.S. Cl. ..... 313/414; 313/412

[58] Field of Search ..... 313/414, 412

[56] References Cited

U.S. PATENT DOCUMENTS

| | | | |
|---|---|---|---|
| 4,275,332 | 6/1981 | Ashizaki et al. | 313/414 |
| 4,400,649 | 8/1983 | Chen | 313/414 |
| 4,517,488 | 5/1985 | Say | 313/414 |
| 4,583,024 | 4/1986 | Chin | 313/414 |
| 4,599,534 | 7/1986 | Shirai et al. . | |
| 4,626,738 | 12/1986 | Gerlach . | |

*Primary Examiner*—Sandra L. O'Shea
*Assistant Examiner*—Vip Patel
*Attorney, Agent, or Firm*—Finnegan, Henderson, Farabow, Garrett & Dunner

[57] ABSTRACT

An electron gun for a color cathode-ray tube for providing a passage for a plurality of electron beams, each beam representing a color component for forming a color image. The electron gun of the present invention includes a pair of electrodes substantially symmetrical to one another with respect to the horizontal direction and coaxial with the tube in the axial direction. Each electrode has a common opening. Each common opening faces the other and is spaced from the other at a given distance in the axial direction. According to an embodiment of the present invention, each electrode includes first and second electrode member. The first electrode member inside the electrode is spaced at a given distance from the common opening of the electrode in the axial direction. The first electrode member includes a plurality of openings in cascade in the horizontal direction, and these openings partially overlap one another and communicate to one another collectively to form a singly aperture. Each opening corresponds to a respective one of the plurality of electron beams. The second electrode member inside the electrode is spaced from the first electrode member at a given distance in the axial direction and further away from the common opening of the electrode than the first electrode member.

30 Claims, 5 Drawing Sheets

ELECTRON GUN FOR COLOR CATHODE-RAY TUBE

BACKGROUND OF THE INVENTION

A. Field of the Invention

The present invention relates to an electron gun for a color cathode-ray tube, and more particularly to a configuration of electrodes of an electron gun constituting a main electrostatic focusing lens.

B. Description of the Prior Art

A conventional color cathode-ray tube with an in-line type electron gun is shown in FIG. 1. A glass envelope 1 of the tube is composed of a front panel 2 and a funnel 3 connected to panel 2. A fluorescent screen which is coated with three color phosphors for developing a color image is disposed on the inner wall of panel 2. A shadow mask 4 for color selection is disposed inside envelope 1 adjacent panel 2 and spaced from the fluorescent screen.

An electron gun 5 is coaxially disposed inside the tubular neck portion of funnel 3 to generate and direct three electron beams (each beam representing a respective one of three primary colors) along coplanar convergent paths through shadow mask 4 to the fluorescent screen. More specifically, the electron beams, which are composed of thermions, are emitted from cathodes 6, 7 and 8 of electron gun 5, and pass through corresponding apertures in first and second grid electrodes 9 and 10. Then each of the electron beams is directed along a respective one of electron beam paths 11, 12, and 13 (shown in solid lines in FIG. 1) to panel 2. Each of cathodes 6, 7 and 8 and its corresponding apertures in first and second grid electrodes 9 and 10 has an axis parallel to the other on a common plane, and each axis is coincident with a respective one of electron beam paths 11, 12 and 13.

Referring to FIG. 1, a line Z—Z extending along the central electron beam path 12, i.e., the center of electron beam paths 11, 12 and 13, to panel 2 is called the "axial direction". Similarly, a line X—X, which is perpendicular to the axial direction and extending across a common plane including electron beam paths 11, 12 and 13, is called the "horizontal direction". A line Y—Y (not shown), which is perpendicular to the axial and horizontal directions, is called the "vertical direction."

Each of the three electron beams travels through second grid electrode 10 along a respective one of electron beam paths 11, 12 and 13 on a common plane and then through third and fourth grid electrodes 14 and 15. Third and fourth grid electrodes 14 and 15 constitute auxiliary focusing lens. Then, each of the electron beams travels through first and second accelerating/focusing electrodes 16 and 17 constituting the main focusing lens of the electron gun. In the main focusing lens, a potential of 25 KV~35 KV is applied to second accelerating/focusing electrode 17 and a potential of about 20%~30% of that applied to second electrode 17 is applied to first electrode 16.

Since the center portion of the main focusing lens is coaxial with the central electron beam path 12, the central beam of the three electron beams, which travels through the center portion of the main focusing lens, is focused to be thin and accelerated to travel straight along the axial direction to the fluorescent screen. However, since the outer portions of the main focusing lens are not coaxial with the central electron beam path 12, the two outer beams of the three electron beams which travel through the outer portions of the main focusing lens are not only focused to be thin, but also subjected to a converging effect toward the central electron beams. Thus, the three electron beams are converged onto shadow mask 4 in an overlapping fashion and then accelerated to reach the fluorescent screen to form colors thereon.

To scan electron beams on the fluorescent screen, an external magnetic deflection yoke 18 is externally provided adjacent glass envelope 1. The above operation for thinning electron beams by the main focusing lens is called "focusing" and the above operation for converging electron beams by the main focusing lens is called "static convergence."

FIG. 2 illustrates a partially cutaway perspective view of first and second accelerating/focusing electrodes 16 and 17 constituting the main focusing lens of the prior art electron gun of FIG. 1. First accelerating/focusing electrode 16 is composed of a non-cylindrical tube with one end open ("open end") and another end (opposite the open end) partially closed ("closed end"). More specifically, first electrode 16 includes an envelope 19 and a closed end face 20 on the closed end integral with envelope 19. Closed end face 20 includes three separate beam passage apertures 111, 112, and 113 which are axially parallel to one another. Each of beam passage apertures 111, 112 and 113 is surrounded by a respective one of cylindrical lips 121, 122 and 123. Each cylindrical lip is projected from closed end face 20 inwardly toward the open end of envelope 19.

Second accelerating/focusing electrode 17 has substantially the same configuration as first electrode 16 and is symmetrical to first electrode 16 with respect to the horizontal direction. Second accelerating/focusing electrode 17 includes an envelope 21 and a closed end face 22 integral with envelope 21. Closed end face 22 includes three electron beam passage apertures 131, 132, and 133. Each of beam passage apertures 131, 132 and 133 is surrounded by a respective one of cylindrical lips 141, 142 and 143. Each cylindrical lip is projected from closed end face 22 inwardly toward the open end of envelope 21.

The outer beam passage apertures 111 and 113 of first accelerating/focusing electrode 16 are spaced from the central beam passage aperture 112 at an equal first distance, i.e., the center to center distance, along the horizontal direction. This distance coincides with the distance between each of the outer electron beam paths 11 and 13 and the central electron beam path 12 (shown in FIG. 1). Likewise, the outer beam passage apertures 131 and 133 of second accelerating/focusing electrode 17 are spaced from the central beam passage aperture 132 at an equal second distance. The second distance is slightly greater than the first distance. Closed end faces 20 and 22 of respective first and second accelerating/focusing electrodes 16 and 17 face one other and are spaced from one another at a given distance "g".

In this prior art configuration, three separate main focusing lenses are provided, each lens for a respective one of the three electron beams. For example, three pairs of electron beam passage apertures, a first pair having the outer apertures 111 and 131, a second pair having the central apertures 112 and 132, and a third pair having the outer apertures 113 and 133, are provided in first and second accelerating/focusing electrodes 16 and 17. Each pair of electron beam passage apertures are surrounded by a respective one of a first pair of lips 121 and 141, a second pair of lips 122 and 142, and a third pair of lips 123 and 143. Each of the three separate main focusing lenses focuses a respective one of the three electron beams which travels through a respective pair of electron beam passage apertures.

Since the second distance corresponding to beam passage apertures 131, 132, and 133 of second accelerating/focusing electrode 17 is greater than the first distance corresponding to beam passage apertures 111, 112, and 113 of first accelerating/focusing electrode 16, the central main focusing lens, which includes a pair of the central beam passage apertures 112 and 132, is coaxial with respect to the axial direction, while the outer main focusing lenses, which include a pair of the outer beam passage apertures 111 and 131 and a pair of the outer beam passage apertures 113 and 133, are not coaxial with respect to the axial direction.

Accordingly, the central electron beam passing through the central main focusing lens is focused to be thin and accelerated to travel straight along the axial direction to the fluorescent screen, while the outer electron beams passing through the outer main focusing lenses are not only focused to be thin, but also subjected to a converging effect toward the central electron beam.

Generally, the resolution of a color cathode-ray tube is affected by the focusing characteristics of the electron gun therein. The focusing characteristics of a color cathode-ray tube are closely related to the aperture diameter of the main focusing lens of the electron gun. More specifically, the magnification and spherical aberration of the main focusing lens affect the focusing characteristics of a color cathode-ray tube. These factors depend strictly on the intensity of the focusing effect of the main focusing lens. That is, if the size or diameter of the electrostatic lens is increased by a ratio R, the second axial derivative of a potential inside the electrostatic lens is decreased by $1/R^2$.

As a result, a strength A of the lens is: $A \sim 1/R$, and a spherical aberration C of the lens is: $C \sim 1/R^3$. Accordingly, spherical aberration C can be significantly reduced by the enlargement of the aperture diameter of the main focusing lens, and the magnification of the main focusing lens can be reduced by reducing the strength of the lens. Further, by the following relationship a small electron beam spot can be obtained and thus the focusing characteristics of the lens can be improved:

Diameter of electron beam spot determined by magnification of the main lens $Dx=M \cdot dx$; and Diameter of electron beam spot, resulting from spherical aberration $Dc=\frac{1}{2}M \cdot C \cdot \theta^3$, Where M: magnification of the main focusing lens;

C: coefficient of spherical aberration of the main focusing lens;

dx: size of the imaged object; and

θ: incident angle of the electron beam upon the main focusing lens.

However, in applying the above relationship to the conventional in-line type color cathode-ray tube, since the three main focusing lenses, each lens corresponding to an electron beam, are arranged on a common horizontal plane, the diameter of apertures 111, 112, 113, 131, 132 and 133 in first and second accelerating/focusing electrodes 16 and 17 constituting the main focusing lenses should be less than ⅓ of the inner diameter of the tubular neck portion of glass envelope 1 accommodating electron gun 5. The maximum permissible size of the diameter of the electron beam passage apertures is further restricted when the thickness and machining tolerances of the accelerating/focusing electrodes are considered.

Although the enlargement of the inner diameter of the neck portion to enlarge the diameter of the electron lens is conceivable, this increases deflection power. Further, the enlargement of the diameter of the beam passage apertures increases the center-to-center distance between the apertures, thus adversely affecting the converging-effect.

As a solution to this problem, in U.S. Pat. Nos. 4,599,534 (issued Jul. 8, 1986) and 4,626,738 (issued Dec. 2, 1986), attempts have been made to form the apertures in a separate member to maximize the aperture diameter within the physical constraint, instead of forming the apertures of the first and second acceleration/focusing electrodes directly in the closed end faces of the electrodes as discussed above. In the above patents, to enlarge the effective diameter of the main focusing lens and eliminate astigmatism by equalizing the horizontal and vertical focusing effects of the lens, an electrostatic field control electrode composed of an envelope and a separate electrode plate having elliptical polygonal apertures inside the envelope of the tube is employed.

Although the above approach may help reduce the number of components in the electrostatic field control electrode, to effectively control the deep penetration of electric field into the confronting electrodes in the horizontal and vertical directions, the dimensions of the elliptical or polygonal aperture have to be defined by polynomial or other complex expressions. Thus, the electrode design becomes complicated, and it becomes difficult to make design changes for the electron gun in response to changes in the screen size of the color cathode-ray tube and/or the type of the deflection yoke used therein.

SUMMARY OF THE INVENTION

An object of the present invention is to provide an electron gun with improved focusing characteristics for a color cathode-ray tube, particularly where the dimensions of the main focusing lens of the electron gun are restricted by the inner diameter of the neck portion of the glass envelope of the tube which accommodates the electron gun therein.

Another object of the present invention is to provide an electron gun having apertures of a simple shape to simplify the design of the electron gun and easily implement changes in the design of the electron gun.

To achieve the objects and in accordance with the purpose of the invention, according to an embodiment of the present invention as broadly described herein, the electron gun of the present invention comprises means for generating a plurality of electron beams, each beam representing a color component for forming a color image, and a pair of main focusing electrode means being substantially symmetrical to one another with respect to the horizontal direction and coaxial with the tube in the axial direction. The pair of main focusing electrode means are coupled to the generating means for providing a passage for the electron beams. Each main focusing electrode means has a common opening, and each common opening faces the other and is spaced from the other at a given distance. Each main focusing electrode means includes first and second electrode members. The first electrode member inside the main focusing electrode means is spaced from the common opening of the electrode means at a given distance in the axial direction. The first electrode member includes a plurality of openings in cascade in the horizontal directions. The plurality of openings partially overlap one another with one or more overlapping regions, and communicate to one another to form a single aperture. Each of the plurality of openings corresponds to a respective one of the plurality of electron beams. The second electrode member is spaced from the first electrode member at a given distance in the axial direction further away from the common opening of the electrode means than the first electrode member.

According to another embodiment of the present invention as broadly defined herein, each electrode means includes a rim adjacent the common opening of the electrode means, the rim including a track member extending a distance from the periphery of the common opening inside the electrode means and a chain link member having a plurality of partially overlapping openings constituting a single aperture, and a control electrode plate inside the electrode means and spaced from the rim at a given distance.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
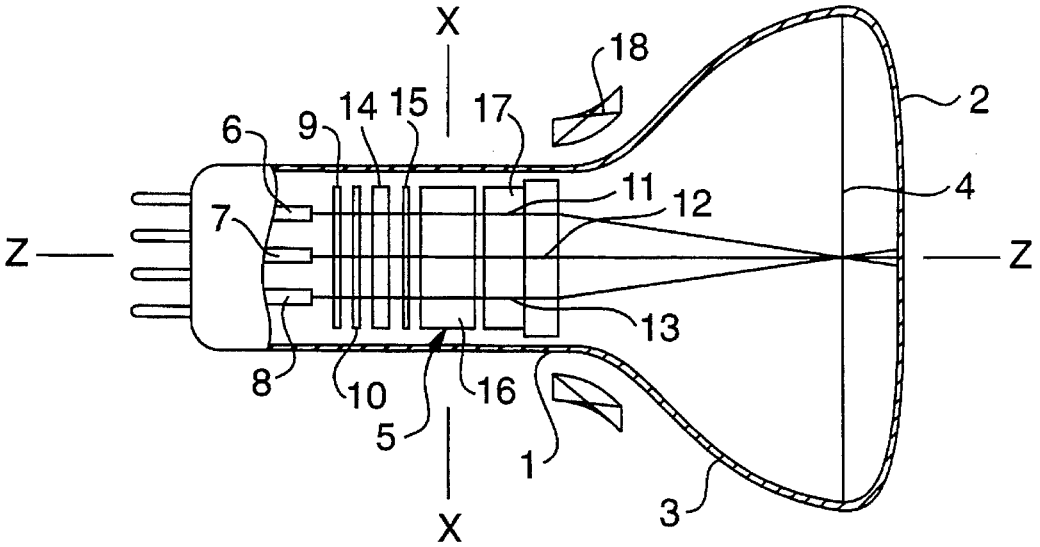
FIG. 1 PRIOR ART
FIG. 1 is a horizontal cross sectional view of a prior art color cathode-ray tube.
Figure 2:
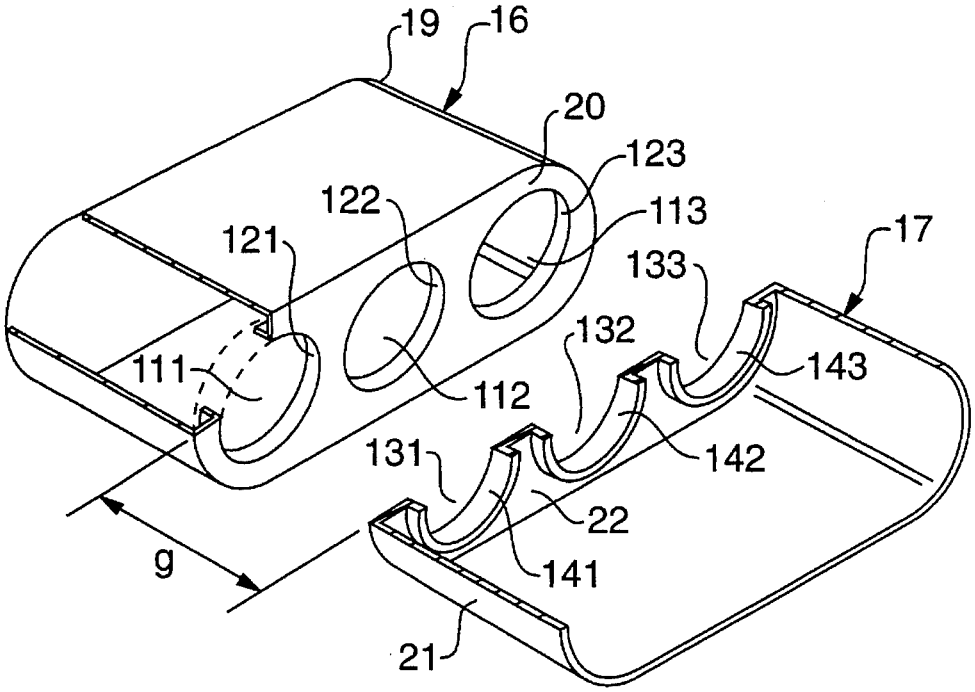
FIG. 2 PRIOR ART
FIG. 2 is a perspective view of a partially cutaway portion of the main focusing lens of an electron gun of the prior art color cathode-ray tube of FIG. 1.
Figure 3:
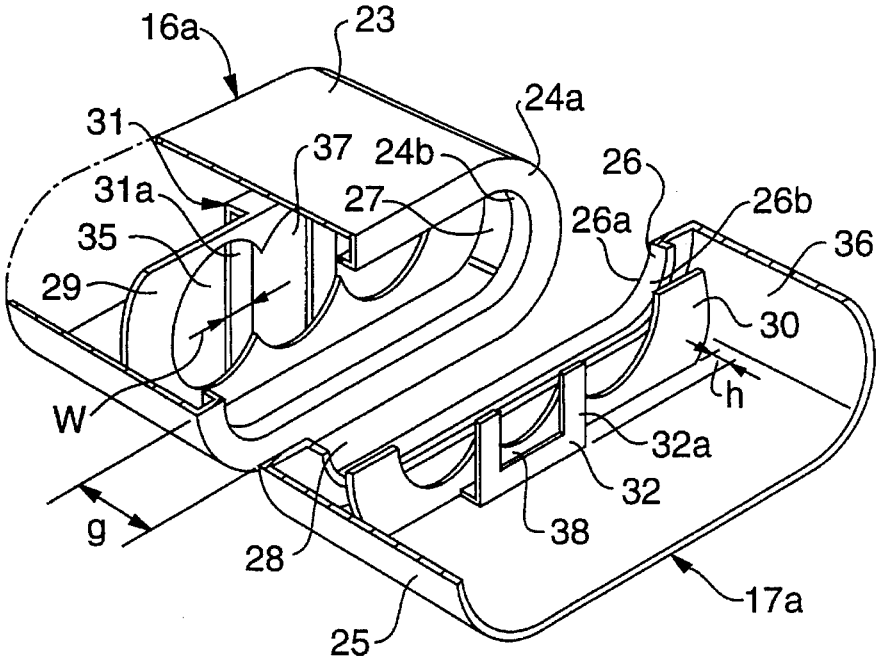
FIG. 3 is a perspective view of a partially cutaway portion of the main focusing lens of an electron gun of a color cathode-ray tube according to a first preferred embodiment of the present invention.

FIG. 3 shows a perspective view of a partial cutaway portion representing the essential part of an electron gun for a color cathode-ray tube according to a first preferred embodiment of the present invention. First and second accelerating/focusing electrodes 16*a* and 17*a* face one another and constitute the main focusing lens of the electron gun. Each of first and second electrodes 16*a* and 17*a* includes a non-cylindrical tube with a respective one of envelopes 23 and 25. Each envelop 23 (or 25) has an opening on one end ("open end") and a common opening 27 (or 28) on the opposite end. These openings are preferably of an elliptic shape (or hereinafter referred to as a "track" shape) having a dimension in the horizontal direction greater than a dimension in the vertical direction.

Each common opening 27 (or 28) provides a passage for electron beams, and preferably includes a rim 24 (or 26) adjacent its periphery. Common opening 27 of first electrode 16*a* and common opening 28 of second electrode 17*a* face one another. Rim 24 (or 26) preferably includes a rim face 24*a* (or 26*a*) on the periphery of the common opening facing the opposite common opening and a narrow track 24*b* (or 26*b*). The peripheral portion of common opening 27 (or 28) is bent (or folded) inwardly of envelop 23 (or 25) toward the open end thereof to form narrow track 24*b* adjacent the inner wall of common opening 27 (or 28). This narrow track constitutes rim 24 (or 26).

First electrode 16*a*, as embodied herein, includes a first electrode member 29 inside envelope 23 and first electrode member 29 is spaced (or hereinafter referred to as "recessed") at a given distance from rim face 24*a* (or the periphery of common opening 27). Likewise, second electrode 17*a* includes a first electrode member 30 inside envelop 25 and first electrode member 30 is recessed at a given distance from rim face 26*a* (or the periphery of common opening 28). Each first electrode member 29 (or 30), as embodied herein, includes three partially overlapping openings in cascade in a chain form. These three openings communicate with one another and collectively constitute a single aperture 35 (or 36). Each of the three openings provides a passage for a respective one of the electron beams and is preferably of a circular shape.

First electrode 16*a*, as embodied herein, further includes a second electrode member 31 adjacent first electrode member 29 and second electrode member 31 is spaced from first electrode member 29 at a given distance h and recessed further away from rim face 24*a* relative to first electrode member 29. Likewise, second electrode 17*a* further includes a second electrode member 32 adjacent first electrode member 30 and second electrode member 32 is spaced at a given distance h from first electrode member 30 and recessed further away from rim 26*a* relative to first electrode member 30.

Each second electrode member 31 (or 32) includes a pair of substantially vertical frame members spaced from one another in the horizontal direction and parallel to one another with respect to the vertical direction. Each vertical frame member has a given width "w", and is disposed adjacent a respective one of two overlapped portions of the three openings of single aperture 35 of first electrode member 29 (or 30). Each vertical member is spaced from the respective overlapped portion at given distance h and recessed further away from rim 25 (or 26) relative to first electrode member 29 (or 30).

According to the first embodiment of the present invention, first electrode 16*a* (or second electrode 17*a*) includes first electrode member 29 (or 30) and second electrode member 31 (or 32) of which members are spaced from one another at given distance h. Further, in second electrode member 31 (or 32), the pair of vertical frame members are preferably connected to one another on one end portion thereof by a horizontal frame member, forming a rectangular frame 31*a* (or 32*a*) with a rectangular opening 37 (or 38) in a rail form. The vertical dimension of the rectangular opening is preferably greater than the horizontal dimension thereof.

The horizontal member of each rectangular frame 31*a* (or 32*a*) is preferably bent toward first electrode member 29 (or 30) and mechanically connected thereto to secure distance h between first electrode member 29 (or 30) and second electrode member 31 (or 32). First electrode member 29 (or 30) and second electrode member 31 (or 32) together constitute an electrostatic field control electrode plate. This electrostatic field control electrode plate is recessed at a given distance from a respective one of rims 24 and 26.

Each of rim faces 24*a* and 26*a*, which corresponds to the end surface of the common opening of a respective one of first and second accelerating/focusing electrodes 16*a* and 17*a*, faces the other and is spaced from the other at a given distance "g". Therefore, in this configuration of the electrodes of the electron gun of the present invention, as embodied herein, electric fields between first and second electrodes 16*a* and 17*a*, which have the end surfaces of the common opening facing one another, penetrate deeply into the electrostatic field control electrode plates, thereby providing in essence the effect of increasing the effective diameter of the main focusing lens. Therefore, with this configuration of the electron gun of the present invention, the effect which is obtainable by physically enlarging the aperture diameter of the main focusing lens is obtained without such physical enlargement.

Common opening 27 (or 28), as embodied herein, is surrounded by rim 24 (or 26), and has a non-circular (preferably elliptic) shape with a dimension in the horizontal direction greater than a dimension in the vertical direction. Therefore, the penetration of electric fields is greater in the horizontal direction than the vertical direction, making the effective diameter of the main focusing lens in the horizontal direction greater than in the vertical direction. Consequently, the horizontal focusing effect of the main focusing lens is smaller than the vertical focusing effect. As a result, when the electron beam is focused, astigmatism is generated due to the difference between the focal distances in the horizontal and vertical directions.

The electron gun of the present invention effectively corrects such astigmatism. As discussed earlier, for each of first and second accelerating/focusing electrodes 16*a* and 17*a*, the electrostatic field control electrode plate is constituted by first electrode member 29 (or 30) and second electrode member 31 (or 32) inside envelope 23 (or 25) such that the penetration of electric fields is controlled not only in the horizonal and vertical directions, but also in the axial direction.

As described above, the electrostatic field control electrode plate of the present invention, as embodied herein, includes the first and second electrode members. First electrode member 29 (or 30) includes three overlapping openings in cascade in a chain form or configuration constituting a single aperture, and second electrode member 31 (or 32) includes a pair of parallel vertical frame members which preferably defines a rectangular opening 37 (or 38) therebetween. Second electrode member 31 (or 32) is spaced at distance h from first electrode member 29 (or 30) and is further recessed away from rim 24 (or 26) toward the open end of the envelop with respect to the first electrode member 29 (or 30). The first electrode member 29 (or 30) is coaxial with second electrode member 31 (or 32).

In this configuration of the electrodes, the penetration of electric fields is controlled by both first electrode member 29 (or 30) and second electrode member 31 (or 32), thus doubling the controlling effect for effectively correcting astigmatism. Further, since rectangular opening 37 (or 38) of second electrode member 31 (or 32) preferably has a horizontal dimension (in the horizontal direction) smaller than a vertical dimension (in the vertical direction), the penetration of electric fields in the horizontal dimension is relatively suppressed, and the horizontal and vertical focusing effects of each of the three main focusing lenses are made substantially equal to eliminate astigmatism.

However, although rectangular opening 37 (or 38) of the second electrode member substantially equalizes the focusing effects in both the horizontal and vertical directions, potentials at the corner portions of the rectangular opening are not effectively controlled, and therefore a circular beam spot is not obtained on the fluorescent screen. As a measure for controlling the potentials at the corner portions of the rectangular opening of the second electrode member, first electrode member 29 (or 30), which includes three partially overlapping circular openings (each opening preferably of a circular shape) in cascade in a chain form constituting single aperture 35 (or 36), as embodied herein, is disposed adjacent second electrode member 31 (or 32) which includes a rectangular opening such that the corner portions of rectangular opening 37 (or 38) of second electrode member 31 (or 32) are effectively covered by the circular arc portions of the central aperture of first electrode member 29 (or 30). Therefore, the potentials at the corner portions of the rectangular opening of the second electrode member is controlled to effect the formation of a circular beam spot on the fluorescent screen.

An exemplary dimension of the components in the electron gun of the first preferred embodiment of the present invention is shown in Table 1 below.

Table 1

First accelerating/focusing electrode 16*a*

Horizontal diameter of common opening 27 for electron beams surrounded the rim 24: 19.0 mm Vertical diameter of common opening 27: 8.0 mm Distance between rim 24 and first electrode member 29: 3.0 mm Distance between rim 24 and second electrode member 31: 4.0 mm Diameter of the central circular opening in first electrode member 29: 8.0 mm Diameter of the outer circular openings in first electrode member 29: 8.0~10.0 mm Horizontal dimension of rectangular opening 37 in second electrode member 31: 4.4 mm Vertical dimension of rectangular opening 37 in second electrode member 31: 10.0 mm Width w of vertical frame members 31*a* of second electrode member 31: 1.0 mm Second accelerating/focusing electrode 17*a*

Horizontal diameter of common opening 28 for electron beams surrounded by rim 26: 19.0 mm Vertical diameter of common opening 28: 8.0 mm Distance between rim 26 and first electrode member 30: 2.05 mm Distance between rim 26 and second electrode member 32: 3.05 mm Diameter of the central circular opening in first electrode member 30: 8.0 mm Diameter of the outer circular openings in first electrode member 30: 8.0~10.0 mm Horizontal dimension of rectangular opening 38 in second electrode member 32: 5.2 mm Vertical dimension of rectangular opening 38 in second electrode member 32: 10.0 mm Width w' of vertical frame members 32*a* of the second electrode member 32: 0.6 mm Gap g between rims 24 and 26 of first and second accelerating/focusing electrodes 16*a* and 17*a*: 1.0 mm Further, since each electrostatic field control electrode plate is recessed from rim 24 (or 26) of envelope 23 (or 25), converging forces act on the outer electron beams toward the central beam, thus providing a converging effect.

In the first preferred embodiment of the present invention, the two outer circular openings of the three overlapping circular openings of first electrode member 29 (or 30), which three openings together constitute single aperture 35 (or 36) of the electrostatic field control electrode plate, provide an effective aperture diameter of the main focusing lens for the outer electron beams. The diameter of these outer circular openings of single aperture 35 (or 36) of first electrode member 29 (or 30) is preferably greater than the diameter of the central circular opening of the three overlapping circular openings of single aperture 35 (or 36). Further, the diameter of the outer circular openings of single aperture 35 (or 36) of first electrode member 29 (or 30) is preferably made as large as possible within the constraints set by the screen size of a color cathode-ray tube and/or the type of deflection yoke used therein, to converge the outer beams toward the central beam.

Figure 4:
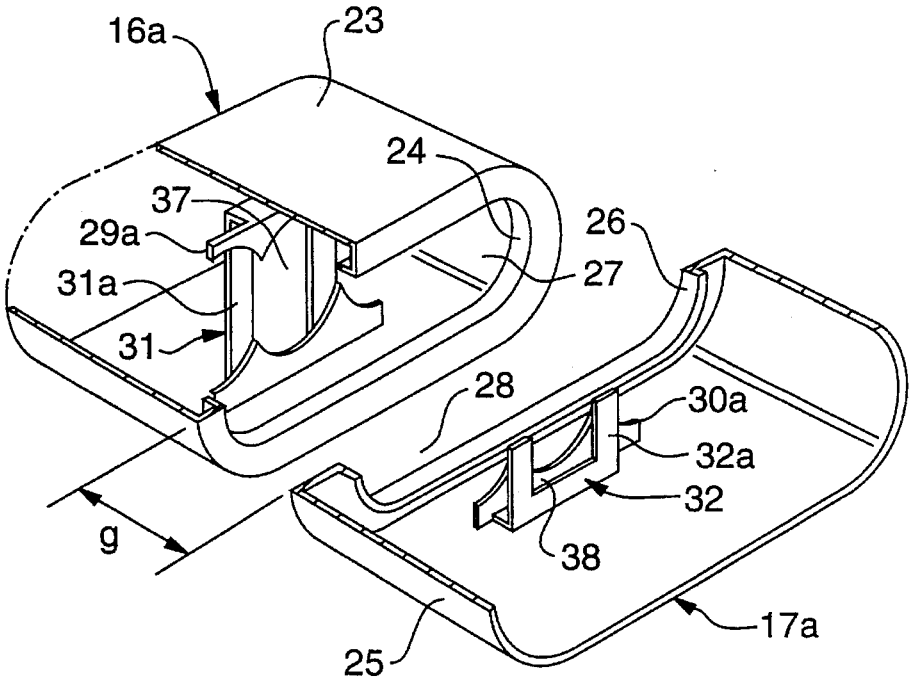
FIG. 4 is a perspective view of a partially cutaway portion of the main focusing lens of an electron gun of a color cathode-ray tube according to a second preferred embodiment of the present invention.

FIG. 4 shows a second preferred embodiment of the present invention. The configuration of the electron gun of the second embodiment is in essence the same as that of the first embodiment (shown in FIG. 3) except for the configuration of the first electrode member of the electrostatic field control electrode plate. In the second embodiment, it is intended that the outer openings of the single aperture of the first electrode member be maximized within given constraints. In FIGS. 3 and 4, the same reference numbers are used to refer to the same or like parts.

Referring to FIG. 4, in the second preferred embodiment, first electrode member 29*a* (or 30*a*) includes three partially overlapping circular openings in cascade in a chain form constituting a single aperture as in the first preferred embodiment. However, in the second preferred embodiment, the outer portions of first electrode member 29*a* (or 30*a*) adjacent the outer half circular portion of each of the two outer circular openings are cut out along the vertical direction. Preferably about half of each of the outer circular openings is cut out. Thus, the remaining portion of the outer circular openings form an arc or a half circle adjacent the central opening.

In other words, the outer end portion of each of the outer circular openings of first electrode member 29*a* (or 30*a*) is open. Therefore, when the electrostatic field control electrode plate is disposed inside envelope 23 (or 25), the outer openings (which now have an arc shape and provide a passage for the outer electron beams) of the single aperture of first electrode member 29*a* (or 30*a*) are effectively defined by the inner wall of envelope 23 (or 25) and the remaining arc portion of the outer circular openings, enlarging the effective diameter of the openings for the outer beams of first electrode member 29*a* (or 30*a*).

Figure 5:
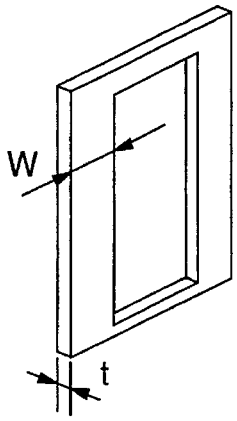
FIG. 5 is a perspective view of a first variation of the second electrode member of the first and second electrodes of the electron gun according to the first and second embodiments of the present invention.

FIGS. 5, 6, 7 and 8 show exemplary variations in the construction of the pair of parallel vertical frame members of second electrode member 31 (or 32) according to the first and second embodiments of the present invention. Referring to FIG. 5, the vertical bars are preferably connected to one another by a pair of horizontal bars to form a rectangular frame in a said form. The width dimension (w) in the horizontal direction of the vertical bar is greater than the depth dimension (t) in the axial direction thereof. Each vertical bar is disposed adjacent a respective one of the overlapping regions of the three overlapping openings of first electrode member 29 (or 30).

Figure 6:
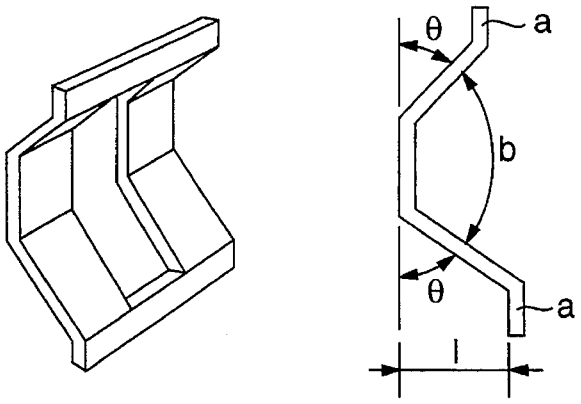
FIG. 6 is a perspective view of a second variation of the second electrode member of the first and second electrodes of the electron gun according to the first and second embodiments of the present invention.

Referring to FIG. 6, the vertical bars are connected to one another, and the width (w) of each vertical bar is preferably greater than the depth (t) thereof, as in FIG. 5. However, in FIG. 6, each vertical bar is bent with several angles. These bent (or angled) vertical bars are substantially parallel to one another in the vertical direction and preferably connected by a pair of horizontal bars to form an opening or aperture of a substantially rectangular shape. The rectangular aperture has the vertical dimension preferably greater than the horizontal dimension.

Each angled vertical bar preferably includes a pair of base members a, a support member b and a pair of connect members c. Each of base members a is substantially parallel to support member b in the vertical direction and spaced therefrom at a distance 1. Each of base members a is connected to support member b by a respective one of connect members c at an angle θ. Angle θ affects the extent of control of astigmatism associated with the electron beams. Each vertical bar is disposed adjacent a respective one of the overlapping regions of the three overlapping openings of first electrode member 29 (or 30).

Figure 7:
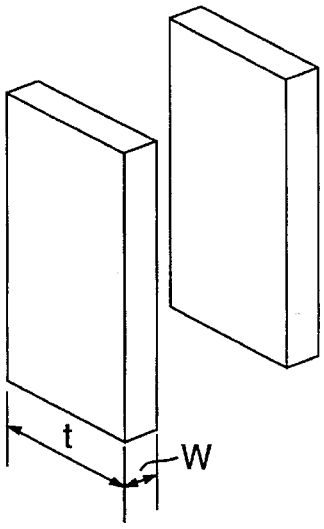
FIG. 7 is a perspective view of a third variation of the second electrode member of the first and second electrodes of the electron gun according to the first and second embodiments of the present invention.

Referring to FIG. 7, second electrode member 31 (or 32) includes a pair of vertical bars substantially parallel to one another in the vertical direction and spaced from one another at a given distance. Each vertical bar is defined by a width w in the horizontal direction and a depth t in the axial direction. The depth t of each vertical bar is preferably greater than the width w.

Figure 8:
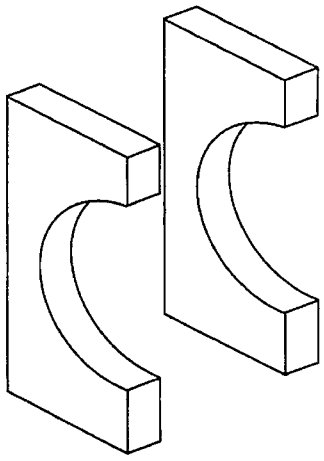
FIG. 8 is a perspective view of a fourth variation of the second electrode member of the first and second electrodes of the electron gun according to the first and second embodiments of the present invention.

Referring to FIG. 8, each vertical bar has a cavity, facing rim 24, in the center portion of the vertical bar. The cavity of each vertical bar has preferably a half oval shape. Alternatively, the cavity of each vertical bar has a half circular shape with a given radius R. Each vertical bar is disposed adjacent a respective one of the spaces between the electron beams representing R, G, B., or a respective one of the overlapping regions of the three overlapping openings of first electrode member 29 (or 30).

According to the preferred embodiments of the present invention, the common openings of the first and second electrodes face one another and each electrostatic field control electrode plate corresponding to a respective one of these common openings is recessed from the rim of the respective common opening. Therefore, the effective aperture diameter of the main focusing lens is increased by the deep penetration of electric fields into the electrostatic field control electrode plate without increasing the distance between the electron beam paths, thus obtaining the same effect obtainable by the physical enlargement of the aperture diameter.

Further, since the electrostatic field control electrode plate is recessed from the rim, subjecting the outer electron beams to a conversion effect toward the central electron beam, a large effective aperture diameter of the main focusing lens is obtained without increasing the distance between the electron beam paths, thereby reducing deflection power and improving focusing and converging characteristics of the lens. Yet further, the electrodes constituting the main focusing lens of the electron gun of the present invention effectively control the penetration of electric fields not only in the horizontal and vertical directions, but also in the axial direction, thus effectively controlling astigmatism. The electron gun of the present invention increases the effective diameter of the main focusing lens without increasing the dimensions of the electrodes constituting the main focusing lens.

Further, the electron gun of the present invention improves the focusing characteristics of the main focusing lens and more effectively controls the deep penetration of electric fields into the electrostatic field control electrode plates in the horizontal and vertical directions in that it does not require the apertures of a complex shape, and that it makes it easier to implement changes in the design of the electron gun in response to changes in the screen size of the tube and/or the type of deflection yoke used therein.

Figure 9:
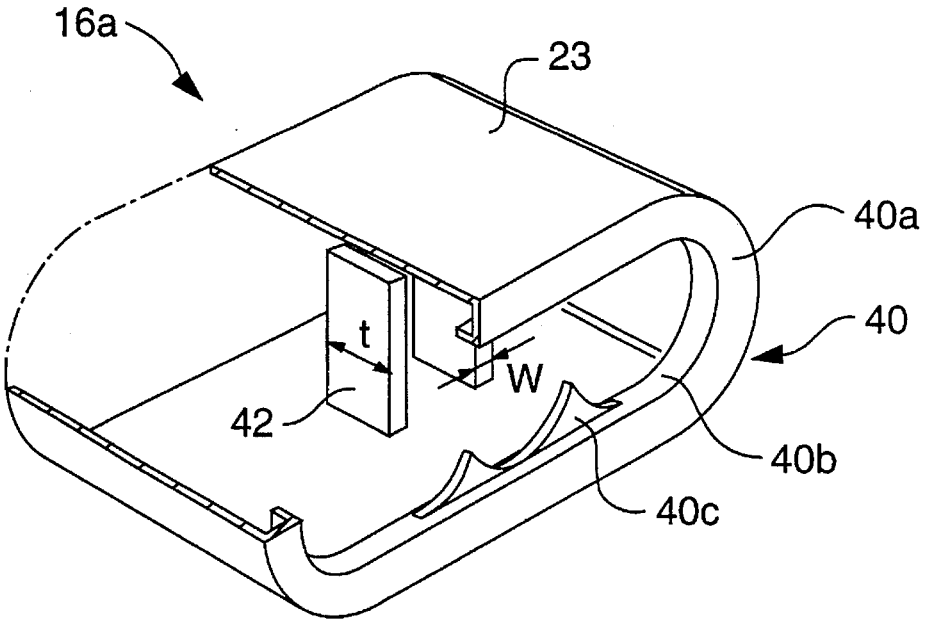
FIG. 9 is a perspective view of a partially cutaway portion of the main focusing lens of an electron gun of a color cathode-ray tube according to a third preferred embodiment of the present invention.

FIG. 9 shows a perspective view of a partially cutaway portion of the main focusing lens of an electron gun for a color cathode-ray tube according to a third preferred embodiment of the present invention. In FIG. 9, the same reference numbers used in FIGS. 3 and 4 are used to refer to the same or like parts. Since first and second electrodes 16*a* and 17*a* are symmetrical along the horizontal axis, only first electrode 16*a* is described here.

Referring to FIG. 9, according to the third embodiment, first electrode 16*a*, as embodied herein, includes a rim 40 and an electrostatic field control electrode plate 42 inside the envelop of first electrode 16*a*. Rim 40 includes a rim face 40*a* on the periphery of the common opening of first electrode 16*a* and facing second electrode 17*a* (not shown), a rim track 40*b* which extends a given distance from rim face 40*a* along the inner sidewall of envelop 23, and a chain link rim member 40*c*. Rim face 40*a* and rim track 40*b* embodied herein are preferably substantially identical to rim face 24*a* and rim track 24*b*, respectively, shown in FIG. 3.

Chain link rim member 40*c*, as embodied herein, preferably includes three partially overlapping substantially circular which openings constitute a single aperture and is preferably substantially identical to first electrode member 29 shown in FIG. 3 or first electrode member 29*a* shown in FIG. 4. Chain link member 40*c*, as embodied herein, is preferably attached to the inner perimeter of rim track 40*b*. Alternatively, chain link rim member 40*c* is disposed inside rim track 40*b* and integral therein. Chain link rim member 40*c* is slightly recessed at a distance from rim face 40*a*.

According to the third embodiment, rim 40 constitutes the common opening of first electrode 16*a* of a noncylindrical shape opposite the end opening thereof. Rim 40, as embodied herein, now preferably includes a narrow rim track 40*b* combined with chain link rim member 40*c* having three partially overlapping circular openings. This combinational rim configuration allows electrostatic field control electrode plate 42 inside envelop 23 of first electrode 16*a* to be of a simple singular structure. Control electrode plate 42 is preferably recessed at a distance from rim 40.

In general, there are two ways for forming an opening of the electrode for providing a common passage for electron beams. One way is to form the rim of the common opening in a track shape (as shown, for example, in FIG. 3) and another is to form it in a chain link shape (as shown, for example, in FIG. 9). The rim of a track shape is preferred because it provides a maximum effective lens diameter.

However, the rim of a track shape has a drawback in that each of the electron beams representing R, G, B is completely open (or exposed) to the other. In other words, the space between the electron beams is not restricted. Therefore, it is difficult to control astigmatism associated with each electron beam. Therefore, to correct such astigmatism, the electrostatic field control electrode plate inside the envelop of the electrode having this type of rim configuration has to be complex or have more than one structural parts.

The rim of a chain link shape includes a chain link member having three partially overlapping circular openings. The partially overlapping regions between these circular openings restrict the space between the electron beams to some extent. Therefore, the electrode having this type of rim configuration effectively controls astigmatism associated with the electron beams representing R, G, B. However, since the rim of a chain link shape does not provide a complete opening, it restricts the effective lens diameter.

The present invention overcomes the above limitations. For example, according to the third embodiments of the present invention, referring to FIG. 9, rim 40 includes narrow rim track 40*b* in combination with chain link member 40*c*. Rim track 40*b* extends inwardly along the inner sidewall of the envelope of the electrode a given distance from the periphery of the envelope to maximize the effective lens diameter. In addition, chain link member 40*c* of rim 40, which is recessed at a given distance from the periphery thereof, circularly restricts the space between the electron beams to some extent, to circularly control the corner portions of the electron beams passing therethrough.

Therefore, with the rim configuration embodied herein, the electrostatic field control electrode plate inside the envelope of this noncylindrical electrode does not have to be complex, and yet effectively eliminates astigmatism both in the vertical and horizontal directions.

For example, referring to FIG. 9, electrostatic field control electrode plate 42, as embodied herein, is recessed at a distance from the common opening (or rim face 40*a*) of first electrode 16*a*, and preferably includes a pair of substantially vertical bars of an equal length substantially parallel to one another in the vertical direction. These vertical bars are spaced from one another at a given distance to form an aperture of a rectangular shape. The vertical dimension of such an aperture is preferably greater than the horizontal dimension. Each of the pair of vertical bars is disposed adjacent a respective one of the overlapping regions of the three partially overlapping circular openings of chain link rim member 40*c* of rim 40. As shown in FIG. 9, each vertical bar is defined by a width dimension w in the horizontal direction and a depth dimension t in the axial direction greater than width dimension w.

In FIG. 9, the structure for only first electrode 16*a* is described for simplicity. The principle applied to first electrode 16*a* can equally be applied to second electrode 17*a*. An exemplary dimension of the components in the electron gun of the third preferred embodiment of the present invention is shown in Table 2 below.

Table 2

First accelerating/focusing electrode 16*a*

Horizontal diameter of the common opening of the electrode surrounded by rim track member 40*b* of rim 40: 19.0 mm Vertical diameter of the common opening surrounded by rim track member 40*b* of rim 40: 8.0 mm Depth of track rim member 40*b* of rim 40 in the axial direction: 0.5~1.2 mm Horizontal diameter of the common opening surrounded by chain link rim member 40*c* of rim 40: 18.0~20.0 mm Diameter of the circular opening of chain link rim member 40*c*: 8.0 mm Depth of chain link rim member 40*c* in the axial direction: 0.5~1.0 mm Distance between electrostatic field control electrode plate 42 and rim 40: 3.0~4.2 mm Horizontal dimension of the rectangular opening of control electrode plate: 5.1 mm Vertical dimension of the rectangular opening of control electrode plate 42: 10.0 mm Depth t of the vertical bar of control electrode plate 42: 2.0 mm Width w of the vertical bar of control electrode plate 42: 0.5 mm Second accelerating/focusing electrode 17*a*

Figure 10:
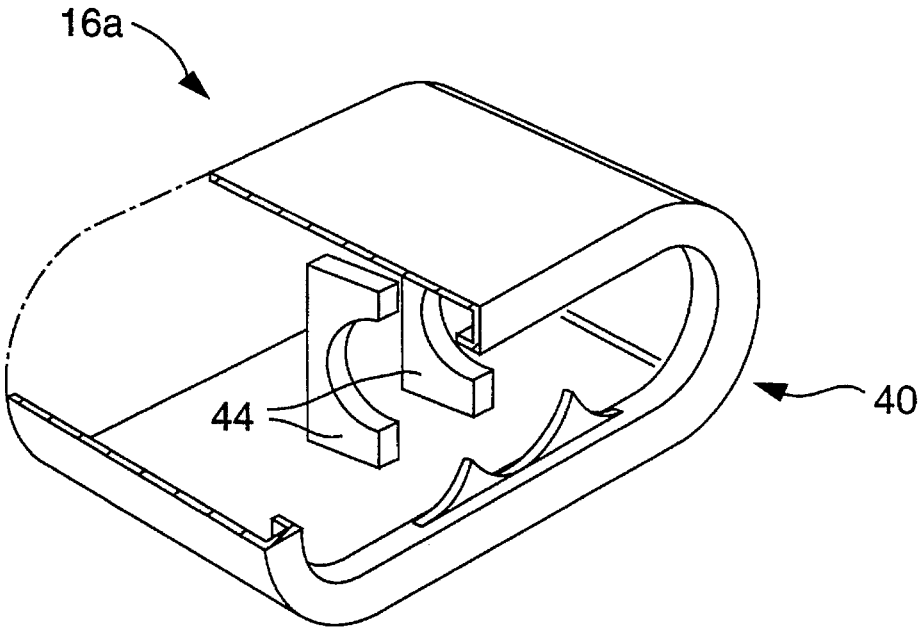
FIG. 10 is a perspective view of a partially cutaway portion of the main focusing lens of an electron gun of a color cathode-ray tube according to a fourth preferred embodiment of the present invention.

Horizontal diameter of the common opening of the electrode surrounded by rim track member 40*b* of rim 40: 19.0 mm Vertical diameter of the common opening surrounded by rim track member 40*b* of rim 40: 8.0 mm Depth of track rim member 40*b* of rim 40 in the axial direction: 0.5~1.2 mm Horizontal diameter of the common opening surrounded by chain link rim member 40*c* of rim 40: 18.0~20.0 mm Diameter of the central circular opening of chain link rim member 40*c*: 7.4 mm Diameter of the outer circular opening of chain link rim member 40*c*: 8.0 mm Depth of chain link rim member 40*c* in the axial direction: 0.5~1.0 mm Distance between electrostatic field control electrode plate 42 and rim 40: 2.1~3.3 mm Horizontal dimension of the rectangular opening of control electrode plate: 5.1 mm Vertical dimension of the rectangular opening of control electrode plate 42: 10.0 mm Depth t of the vertical bar of control electrode plate 42: 2.0 mm Width w of the vertical bar of control electrode plate 42: 0.5 mm FIG. 10 shows a perspective view of a partially cutaway portion of the main focusing lens of an electron gun of a color cathode-ray tube according to a fourth preferred embodiment of the present invention. Referring to FIG. 10, the rim configuration embodied herein is substantially identical to that shown in FIG. 9.

Referring to FIG. 10, according to the fourth embodiment, an electrostatic field control electrode plate 44 is recessed at a distance from the common opening (or rim 40) of first electrode 16*a* and preferably includes a pair of vertical bars substantially parallel to one another in the vertical direction. As in the third embodiment, each vertical bar is defined by width w and depth t preferably greater than the width. However, each vertical bar, as embodied herein, preferably has a cavity, facing rim 40, in the center portion of the vertical bar. The cavity of each vertical bar has preferably a half oval shape. Alternatively, the cavity of each vertical bar has a half circular shape with a given radius R. Each vertical bar is disposed adjacent a respective one of the spaces between the electron beams representing R, G, B. With this control electrode plate configuration, astigmatism associated with the electron beams can be as effectively controlled.

Figure 11:
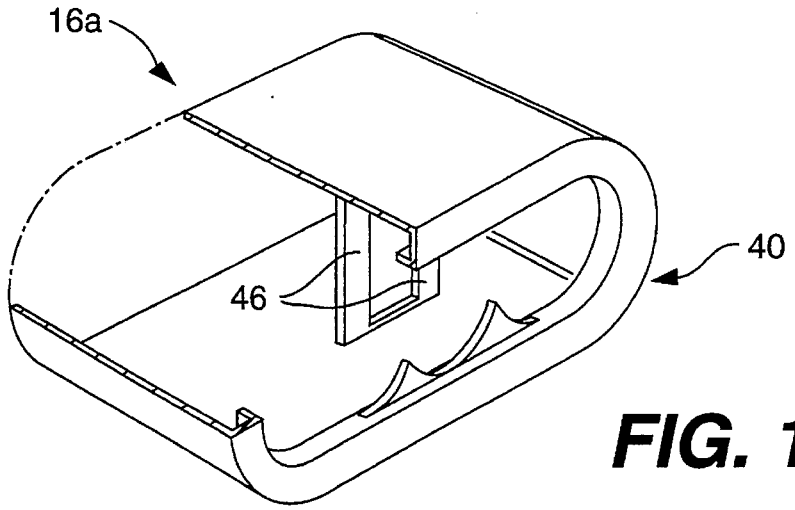
FIG. 11 is a perspective view of a partially cutaway portion of the main focusing lens of an electron gun of a color cathode-ray tube according to a fifth preferred embodiment of the present invention.

FIG. 11 shows a perspective view of a partially cutaway portion of the main focusing lens of an electron gun of a color cathode-ray tube according to a fifth preferred embodiment of the present invention. The rim configuration embodied herein is substantially identical to that shown in FIG. 9.

Referring to FIG. 11, electrostatic field control electrode plate 46, as embodied herein, is recessed at a distance from the common opening (or rim face 40*a*) of first electrode 16*a*, and preferably includes a pair of substantially vertical bars of an equal length substantially parallel to one another in the vertical direction. These vertical bars are preferably connected to one another by a pair of horizontal bars to form an aperture of a rectangular shape. The vertical dimension of such an aperture is preferably greater than the horizontal dimension. Each of the pair of vertical bars is disposed adjacent a respective one of the overlapping regions of the three partially overlapping circular openings of chain link rim member 40*c* of rim 40. Each vertical bar is defined by width dimension w in the horizontal direction and depth dimension t in the axial direction smaller than width dimension w.

Figure 12:
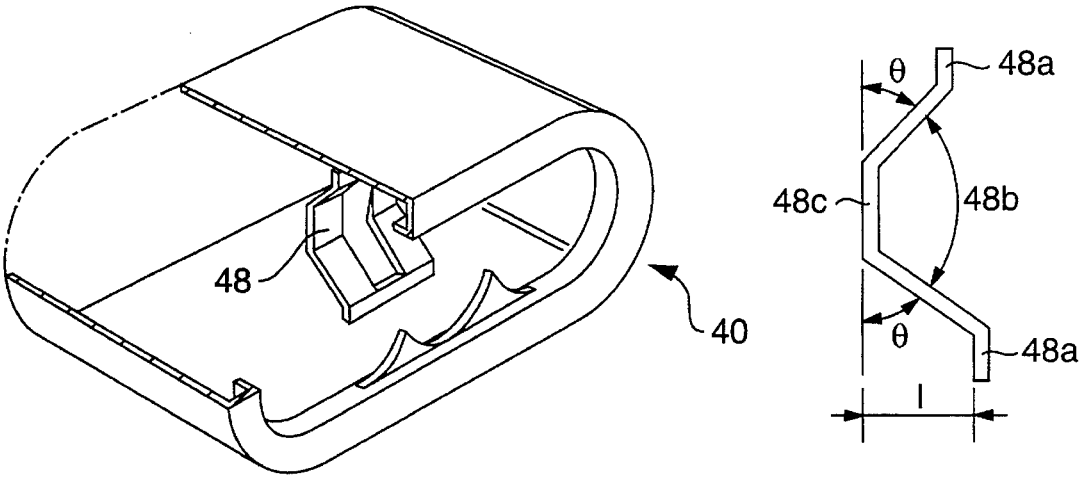
FIG. 12 is a perspective view of a partially cutaway portion of the main focusing lens of an electron gun of a color cathode-ray tube according to a sixth preferred embodiment of the present invention.

FIG. 12 shows a perspective view of a partially cutaway portion of the main focusing lens of an electron gun of a color cathode-ray tube according to a sixth preferred embodiment of the present invention. The rim configuration embodied herein is substantially identical to that shown in FIG. 9.

Referring to FIG. 12, an electrostatic field control electrode plate 48 includes a pair of angled vertical bars of substantially identical shape. These angled vertical bars are substantially parallel to one another in the vertical direction and preferably connected by a pair of horizontal bars to form an opening or aperture of a substantially rectangular shape. The rectangular aperture has a height in the vertical dimension preferably greater than a width in the horizontal dimension.

Each angled vertical bar, as embodied herein, includes a pair of base members 48*a*, a support member 48*b* and a pair of connect members 48*c*. Each of base members 48*a* is substantially parallel to support member 48*b* in the vertical direction and spaced therefrom at a distance 1. Each of base members 48*a* is connected to support member 48*b* by a respective one of connect members 48*c* at an angle θ. Angle θ affects the extent of control of astigmatism associated with the electron beams.

Figure 13:
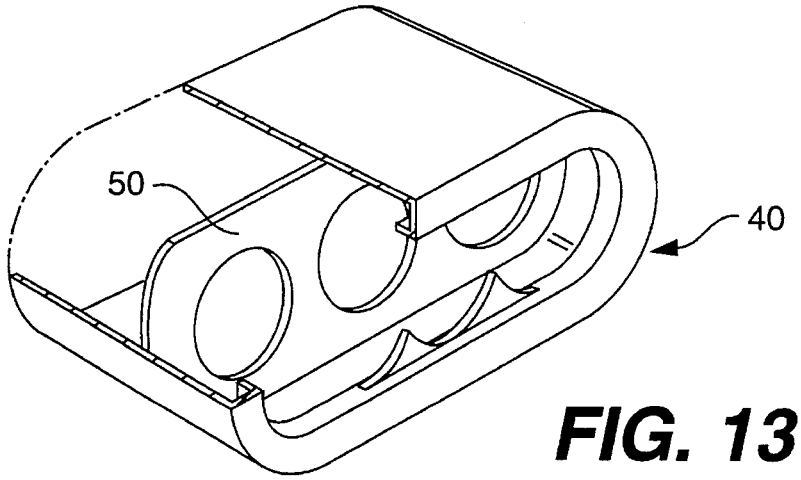
FIG. 13 is a perspective view of a partially cutaway portion of the main focusing lens of an electron gun of a color cathode-ray tube according to a seventh preferred embodiment of the present invention.

FIG. 13 shows a perspective view of a partially cutaway portion of the main focusing lens of an electron gun of a color cathode-ray tube according to a seventh preferred embodiment of the present invention. The rim configuration embodied herein is substantially identical to that shown in FIG. 9.

Referring to FIG. 13, according to the fifth embodiment, an electrostatic field control electrode plate 46 is recessed at a distance from rim 40 and includes a horizontal electrostatic control electrode plate having a plurality of openings, to compensate for astigmatism. Each opening, preferably of a circular shape, corresponds to a respective one of the electron beams and is separated from the other constituting an independent aperture. The diameter of the outer openings is preferably different than that of the central opening in the control electrode plate to effectively control astigmatism associated with the outer beams to the same extent as that associated with the central beam.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electron gun for a color cathode-ray tube having axial, horizontal and vertical directions, said directions being substantially perpendicular to one another, comprising:

means for generating a plurality of electron beams, each beam representing a respective one of color components for forming a color image; and a pair of electrode units substantially symmetrical to one another with respect to the horizontal direction and coaxial with the tube in the axial direction and for providing a passage for said plurality of electron beams, each of said pair of electrode units having a common opening, each common opening of said electrode units facing one another and being spaced from one another by a first distance in the axial direction, each electrode unit including:

a first electrode member inside the electrode unit and spaced from the common opening by a second distance in the axial direction, said first electrode member including a plurality of openings in cascade in the horizontal direction, said plurality of openings partially overlapping one another continuously in the horizontal direction to collectively form a single aperture, each opening corresponding to a respective one of said plurality of electron beams, and a second electrode member inside the electrode unit and spaced from the first electrode member by a third distance in the axial direction and further away from the common opening of the electrode unit than the first electrode member in the axial direction.

2. The electron gun of claim 1, wherein said common opening of the electrode unit has a non-circular shape having a dimension in the horizontal direction greater than a dimension in the vertical direction.

3. The electron gun of claim 1, wherein each of said plurality of openings has a substantially circular shape.

4. The electron gun of claim 1, wherein said plurality of openings of the first electrode member include a central opening and a pair of outer openings, each outer opening partially overlapping the central opening in the horizontal direction and being greater than the central opening.

5. The electron gun of claim 4, wherein each opening has a circular shape with a diameter, the diameter of each of the outer openings being greater than the diameter of the central opening.

6. The electron gun of claim 1, wherein the second electrode member includes a plurality of vertical frame members parallel to one another in the vertical direction and spaced from one another by a fourth distance in the horizontal direction to form a rectangular aperture, each vertical frame member being adjacent a respective one of said at least one overlapping region of the plurality of openings of the first electrode member.

7. The electron gun of claim 6, wherein each of said vertical frame members is defined by a width dimension in the horizontal direction and a depth dimension in the axial direction smaller than the width dimension.

8. The electron gun of claim 6, wherein each of said vertical frame member is defined by a width dimension in the horizontal direction and a depth dimension in the axial direction greater than the width direction.

9. The electron gun of claim 6, wherein said plurality of vertical members of the second electrode member are coupled to one another with a horizontal frame member to form a quadrangle, said quadrangle having a dimension in the vertical direction greater than a dimension in the horizontal direction.

10. The electron gun of claim 6, wherein said rectangular aperture include corner portions, the corner portions being at least partially covered by the first electrode member in the axial direction.

11. The electron gun of claim 6, wherein each of said vertical frame member has a cavity facing said common opening.

12. The electron gun of claim 11, wherein said cavity has a substantially half oval shape.

13. The electron gun of claim 11, wherein said cavity has a substantially semicircular shape.

14. The electron gun of claim 1, wherein said common opening of each electrode unit includes a rim, said rim including:

a track member extending a fifth distance from the periphery of the common opening inside said electrode unit; and a chain link member having a plurality of partially overlapping openings forming a single aperture, each opening corresponding to a respective one of said electron beams.

15. An electron gun for a color cathode-ray tube having axial, horizontal and vertical directions, said directions being substantially perpendicular to one another, comprising:

means for generating a plurality of electron beams, each beam representing a respective one of color components for forming a color image; and a pair of electrode units being substantially symmetrical to one another with respect to the horizontal direction and coaxial with the tube in the axial direction and for providing a passage for said plurality of electron beams, each of said pair of electrode units having a common opening, each common opening of the electrode units facing one another and being spaced from one another by a first distance in the axial direction, each electrode unit including:

a rim adjacent the common opening of said electrode unit, said rim including a track member extending a second distance from a periphery of the common opening inside said electrode unit and a chain link member having a plurality of partially overlapping openings extending continuously in the horizontal direction forming a single aperture, each opening corresponding to a respective one of said electron beams, and a control electrode plate inside said electrode unit and spaced from said rim by a third distance.

16. The electron gun of claim 15, wherein said control electrode-plate includes a pair of vertical bars parallel to one another in the vertical direction and spaced from one another by a fourth distance in the horizontal direction to form a rectangular aperture, each vertical bar being adjacent a respective overlapping region of said partially overlapping openings.

17. The electron gun of claim 16, wherein each of said vertical bars is bent with at least one angle of a nonzero value.

18. The electron gun of claim 16, wherein said control electrode plate further includes a horizontal frame member coupling said pair of vertical bars.

19. The electron gun of claim 16, wherein each of said vertical bars has a cavity facing said rim.

20. The electron gun of claim 19, wherein said cavity has a substantially half oval shape.

21. The electron gun of claim 19, wherein said cavity has a substantially semicircular shape.

22. The electron gun of claim 15, wherein said control electrode plate includes a plate having a plurality of openings separated from one another, each opening corresponding to a respective one of said electron beams.

23. The electron gun of claim 15, wherein said common opening of the electrode unit has a non-circular shape having a dimension in the horizontal direction greater than a dimension in the vertical direction.

24. The electron gun of claim 15, wherein each of said plurality of partially overlapping openings has a substantially circular shape.

25. The electron gun of claim 15, wherein said plurality of partially overlapping openings of the first electrode member include a central opening and a pair of outer openings, each outer opening partially overlapping the central opening in the horizontal direction and being greater than the central opening.

26. The electron gun of claim 25, wherein each opening has a circular shape with a diameter, the diameter of the outer opening being greater than the diameter of the central opening.

27. The electron gun of claim 25, wherein the central opening has a substantially circular shape and each outer opening has an arc shape.

28. An electron gun for a color cathode-ray tube having axial, horizontal and vertical directions, said directions substantially perpendicular to one another, comprising:

means for generating a plurality of electron beams, each beam representing a respective one of plural color components for forming a color image; and a pair of electrode units substantially symmetrical to one another with respective to the horizontal direction and coaxial with the tube in the axial direction and for providing a passage for said plurality of electron beams, each of said pair of electrode units having a common opening, each common opening of said electrode units facing one another and being spaced from one another by a first distance in the axial direction, each electrode unit including:

a first electrode member inside the electrode unit and spaced from the common opening by a second distance in the axial direction, said first electrode member including a plurality of openings in cascade in the horizontal direction, said plurality of openings of the first electrode member including a central opening and a pair of outer openings, each outer opening partially overlapping the central opening in the horizontal direction, the first electrode member having outer end portions adjacent a respective outer portion of each of the outer openings, said outer ends being cut out along the vertical direction, and a second electrode member inside the electrode unit and spaced from the first electrode member by a third distance in the axial direction and further away from the common opening of the electrode unit than the first electrode member in the axial direction.

29. The electrode gun of claim 28, wherein the central opening has a substantially circular shape and each outer opening has a arc shape.

30. The electron gun of claim 29, wherein each electrode unit includes a non-cylindrical tube with an envelope surrounding the tube, said envelope at least partially defining an effective diameter of each outer opening.

* * * * *

UNITED STATES PATENT AND TRADEMARK OFFICE

CERTIFICATE OF CORRECTION

PATENT NO. : 5,506,468

DATED : April 09, 1996

INVENTOR(S) : Nam Jae KOH

It is certified that error appears in the above-indentified patent and that said Letters Patent is hereby corrected as shown below:

In the Abstract, Item [57], delete Abstract in its entirety and insert --An electron gun for a color cathode-ray tube having axial, horizontal and vertical directions, the directions being substantially perpendicular to one another, includes an electron beam generator for generating a plurality of electron beams, each beam representing a respective one of color components for forming a color image. A pair of electrode units which are substantially symmetrical to one another with respect to the horizontal symmetrical to one another with respect to the horizontal direction and coaxial with the tube in the axial direction provides a passage for the plurality of electron beams. Each of the pair of electrode units has a common opening which face one another and is spaced from one another by a first distance in the axial direction. Each electrode unit includes a first electrode member spaced from the common opening by a second distance in the axial

UNITED STATES PATENT AND TRADEMARK OFFICE

CERTIFICATE OF CORRECTION

PATENT NO. : 5,506,468

DATED : April 09, 1996

INVENTOR(S) : Nam Jae KOH

It is certified that error appears in the above-indentified patent and that said Letters Patent is hereby corrected as shown below:

direction and a second electrode member inside the electrode unit spaced from the first electrode member by a third distance in the axial direction and further away from the common opening of the electrode unit than the first electrode member in the axial direction. The first electrode member includes a plurality of openings in cascade in the horizontal direction in which the openings partially overlap one another continuously from front to rear of the first electrode member with at least one overlapping region and affect one another collectively to form a single aperture. Each opening corresponds to a respective one of the plurality of electron beams.--

Claim 28, Column 18, Line 8, change "respective" to --respect--;

UNITED STATES PATENT AND TRADEMARK OFFICE

CERTIFICATE OF CORRECTION

PATENT NO. : 5,506,468

DATED : April 9, 1996

INVENTOR(S) : Nam Jae Koh

It is certified that error appears in the above-indentified patent and that said Letters Patent is hereby corrected as shown below:

Claim 29, column 18, line 39, change "a" to --an--.

Signed and Sealed this

Third Day of December, 1996

*Attest:*

*Attesting Officer*

BRUCE LEHMAN

*Commissioner of Patents and Trademarks*